United States Patent [19]

Gluck et al.

[11] 4,298,920

[45] Nov. 3, 1981

[54] AUTOMATIC GEL CHANGER FOR A SPOTLIGHT

[76] Inventors: Lewis Gluck, 391 W. Jericho Turnpike, Huntington, N.Y. 11743; Robin M. Tannenbaum, 90 Bedford St., New York, N.Y. 10001

[21] Appl. No.: 46,296

[22] Filed: Jun. 7, 1979

[51] Int. Cl.[3] ..... F21V 7/00

[52] U.S. Cl. ..... 362/281; 362/280; 362/293

[58] Field of Search ..... 362/280, 281, 293

[56] References Cited

U.S. PATENT DOCUMENTS

| | | | |
|---|---|---|---|
| 1,740,463 | 12/1929 | Kliegl | 362/323 |
| 1,875,814 | 9/1932 | Kliegl | 362/323 |
| 2,129,641 | 9/1938 | Baushman et al. | 362/284 |

*Primary Examiner*—Stephen J. Lechert, Jr.

*Attorney, Agent, or Firm*—Wolder, Gross & Yavner

[57] ABSTRACT

An automatic gel changer for remote operation, including a rotary solenoid associated with each gel frame to rotate such frames in and out of the path of the beam of light from the spotlight. Also associated with each gel frame is a damper for causing the motion of the gel frames as provided by the solenoids to be smooth and continuous.

4 Claims, 7 Drawing Figures

AUTOMATIC GEL CHANGER FOR A SPOTLIGHT

This invention relates primarily to spotlights and more particularly to remote gel changers therefor.

Every theatre makes use of spotlights to illuminate various areas on the stage during a performance. Associated with such spotlights is a filter or colored gel changer for causing various colored filters to intercept the beam of light from the spotlight, thereby causng colored rather than white light illumination. The most common structure for changing color is with the use of separate spotlights each having an individual color gel, to be turned on or off on cue. Another existing form for such gel changers is usually a large circular element rotatable about its center and with a plurality of colored circular filters or gels placed around the center. Commonly, a spotlight operator will change the color of the light from the spotlight manually on cue by simply rotating the gel changer about its center to place a particular gel in position to intercept the beam of light from the spotlight.

Articulation of the gel changer is also performed with hydraulic piston arms, either with a single piece gel changer as described above in connection with the manual system, or in association with individual gel frames that are moved in and out of the beam of light by hydraulic means.

The manual system described above is extremely cumbersome in that an operator is required for each spotlight and the placement of such spotlight must be in a position in the theatre enabling the coincident positioning of a spotlight and gel changer operator. Also, such devices lack compactness.

Hydraulic piston systems are not completely satisfactory in that the temperature in the immediate vicinity of the spotlight can reach as much as 300° Fahrenheit, which can damage such hydraulic pistons in a manner which cuts down their efficiency.

Furthermore, such systems have not served to produce smooth operation for the gel changing mechanism. In other words, with presently existing systems, chatter of the gel frame is common as it is moved into and out of position in the beam of light, particularly at the end of its path traversal.

Accordingly, a primary object of the present invention is to provide a gel changer mechanism which is operable remotely from the spotlight with which is associated, and which permits random access for a plurality of gels and enables mixing colors to create other colors, yet still allows white light illumination on cue.

A further object of the present invention is to provide a gel changer mechanism for a spotlight which is capable of withstanding the temperatures generated thereby, without loss of efficiency.

A still further object of the present invention is to provide a gel changer mechanism for a spotlight, which includes means for enabling smooth operation with respect to the motion of gel frames, and which may be used in any orientation including inverted position and positions between inverted and normal position.

Another object of the present invention is to eliminate the necessity for a plurality of light fixtures and associated electronic dimmer interfaces and power cords.

These and other objects of the present invention are provided in a remote gel changer for a spotlight which features either individual or random access or multiple gel frames for motion between a removed position and a position for intercepting the beam of light from the spotlight. A rotary solenoid is associated with each gel frame for causing such motion, with each rotary solenoid electrically operated, the switching for the electrical circuit for the solenoid being at a remote distance from the spotlight. Also associated with each gel frame is a damper for providing smooth motion of the frame as caused by the rotary solenoid. By such a structure, the present invention provides a device that is easily attached to various size and style spotlights, thus making one spotlight accomplish the work of many.

Other objects, features and advantages of the present invention will become apparent by reference to the following more detailed description of a preferred, but nonetheless illustrative, embodiment, with reference to the accompanying drawings, wherein.

Figure 1:
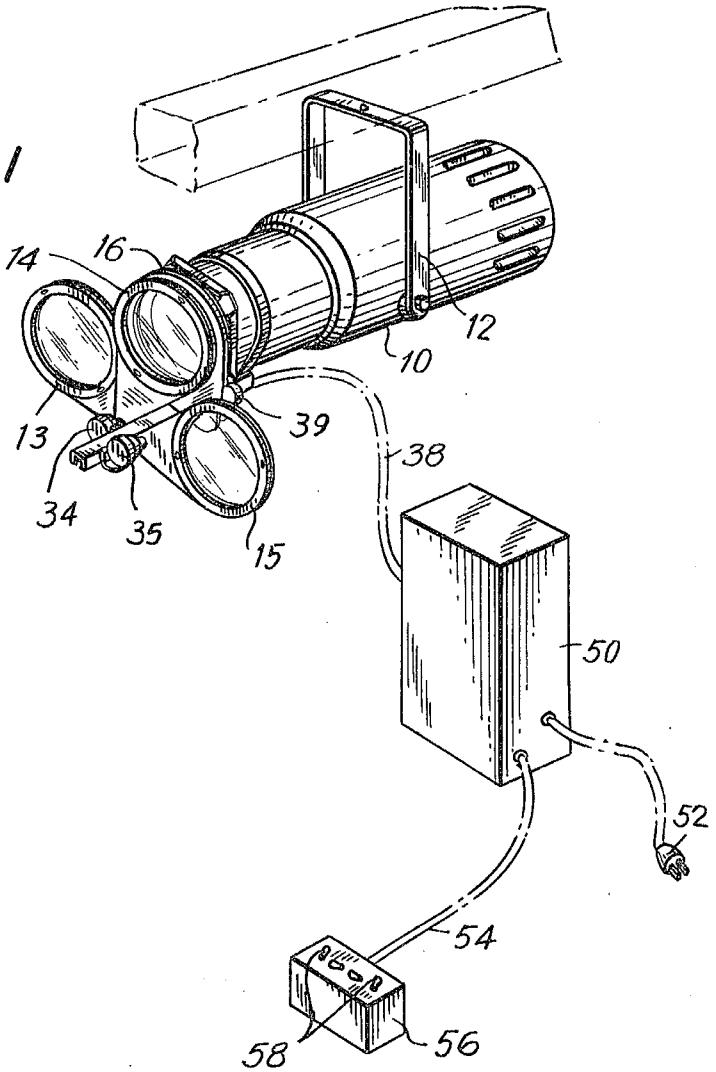
FIG. 1 is an isometric representation showing individual gel frames movable in and out of a beam of light projected by a spotlight, the gel frame motion being caused by electrically operated and remotely switched rotary solenoids, and the motion being damped by dampers associated with each frame.

Referring to the drawings, a spotlight 10 is shown in FIG. 1 as mounted by bracket 12. Spotlight 10 is commonly available and may be seen in most theaters or auditoria. The function of spotlight 10 is to generally collimate a beam of light to illuminate a small portion of the performance, such as an actor's upper body, or a small area of scenery. Typically, such spotlights 10 are associated with a front end attached gel changer wherein various gel frames are rotatable into and out of the beam of light projected by spotlight 10. Likewise, in the present invention, as shown in FIG. 1, a plurality of gel frames 13–16 are connected with spotlight 10 and rotatable in a plane perpendicular to the axis of the spotlight.

Figure 5:
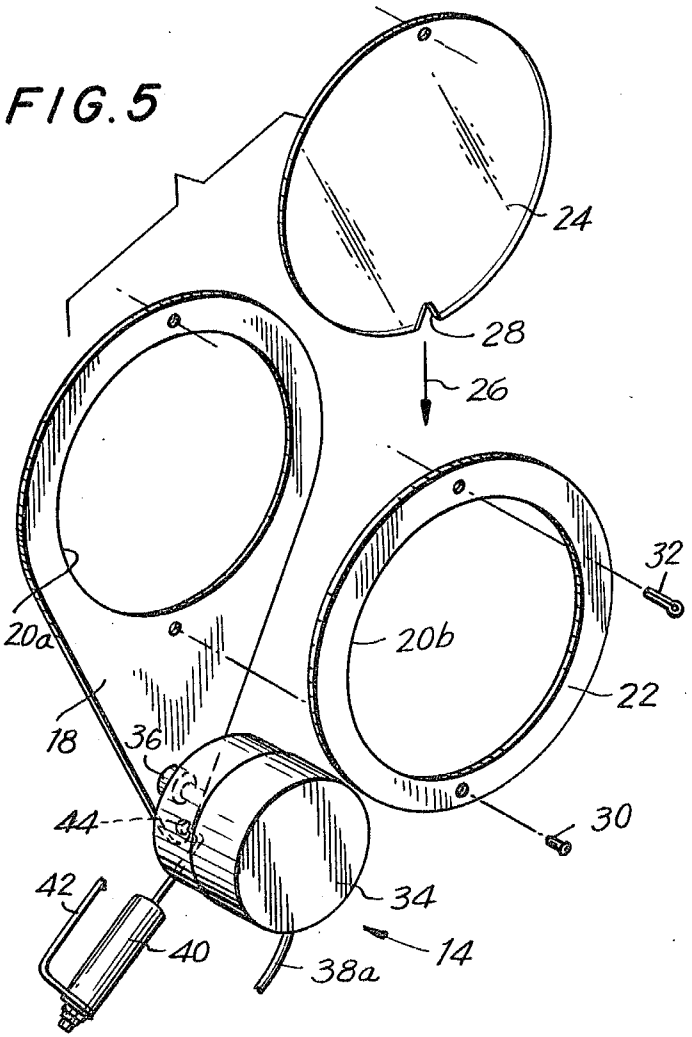
FIG. 5 is an exploded view showing the elements of a single gel frame with associated damper and rotary solenoid.

The exploded view of FIG. 5 shows gel frame 14 in detailed construction. Frame base 18 is generally triangular in form, the broadest area of which defines first gel opening 20*a*. Frame member 22 is circular in shape, defining a second gel opening 20*b*. Frame base 18 and frame member 22 are attached to each other with gel or filter 24 inserted therebetween in the direction of arrow 26. Gel 24 is provided with notch 28 for locating gel 24 with respect to gel openings 20*a*, 20*b*. Thus, notch 28 fits locating screw 30 which projects through and attaches frame member 22 and frame base 18. Likewise, a cotter pin 32, or the like, projects through and attaches frame member 22, gel 24 and frame base 18. The entire assembly, as just described, is rotatably attached to rotary solenoid 34 by means of axle 36, which is rotatable by solenoid 34 in response to electrical current supply through wire 38*a*. Also, damper 40, rigidly affixed with respect to spotlight 10 by bracket 42, is attached at point 44 of gel frame 14 spaced from the attaching point for axle 36. Damper 40 is of the commonly available air variety wherein a piston compresses air in a cylindrical housng in order to provide a smoother motion for the item to which the piston is attached.

Figure 4:
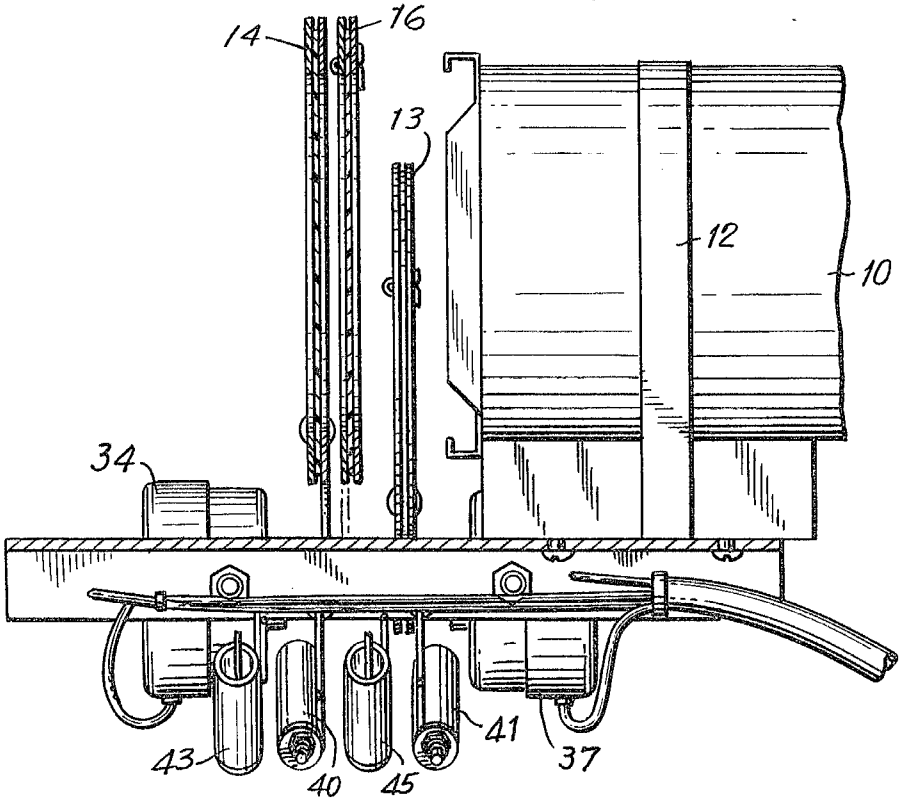
FIG. 4 is a side sectional view taken along the line 4—4 of FIG. 2.
Figure 2:
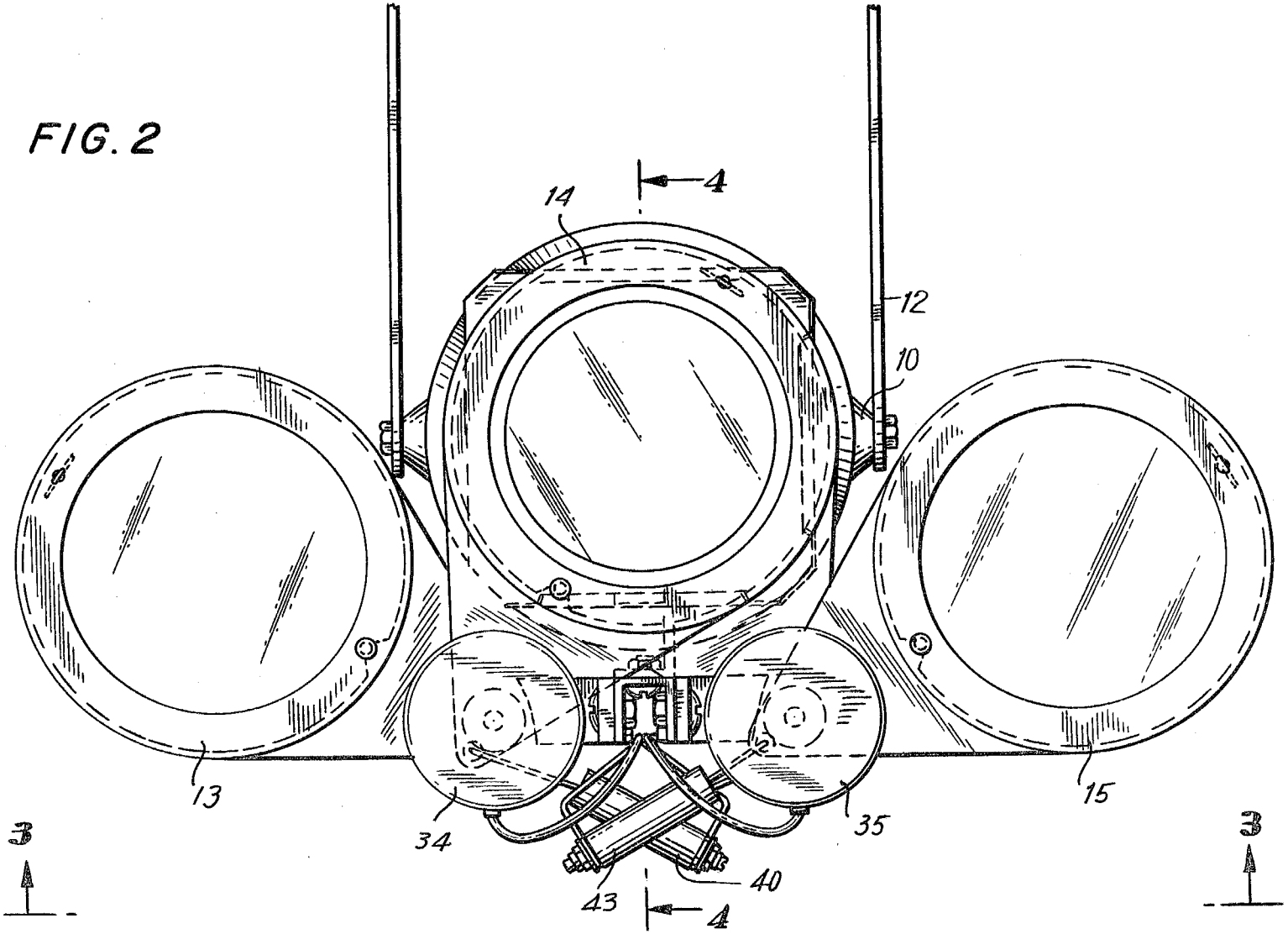
FIG. 2 is a front view of the mechanism of FIG. 1, showing particularly the damping means for smoothing gel frame motion.

Referring back to FIG. 1, each gel frame 14, 13, 15, 16 is of similar construction and each is associated with a rotary solenoid 34, 37, 35 and 39 and a damper 40, 41, 43, and 45 (FIG. 4).

FIG. 1 also shows wire trunk 38 leading electrical energy into the gel changer of the present invention from electrical circuitry 50, which is connected to a power source by means 52. Electrical circuit 50 is also connected by wire 54 to remote unit 56, including switches 58 for remote control of the gel changer.

Figure 3:
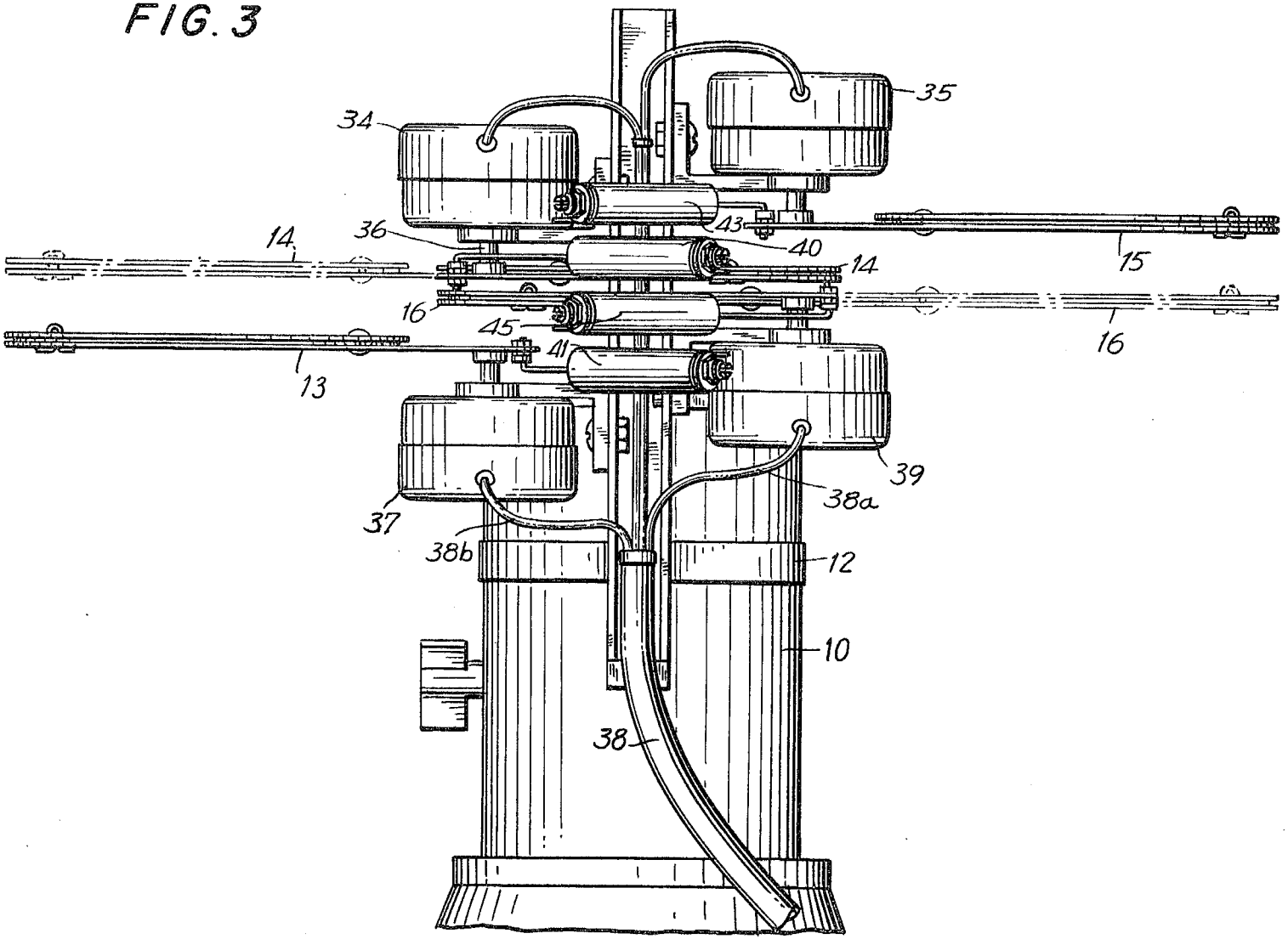
FIG. 3 is a bottom plan view of the mechanism of FIG. 2, showing particularly the dampers and rotary solenoids connected to each gel frame.

The bottom plan view of FIG. 3 is useful for illustrating operation of the present invention. Spotlight 10 emits an illuminating beam and, presuming the initial position wherein gel frames 13–16 are all in a removed position with respect to intercepting the beam of light, such gel frames may be remotely caused to enter the path of the beam through use of electrical wire trunk 38. For instance, remote switches 58 (FIG. 1) are actuated such that electrical energy is passed into rotary solenoid 34 so that axle 36 rotates to move gel frame 14 into register with the beam of light, such motion being damped by air damper 40. Rotary solenoid 34 is spring biased to a removed position for gel frame 14, so that that frame will stay in register with the beam as long as energy is transmitted to rotary solenoid 34. Moving the appropriate switch 58 into "off" position enables the spring, not shown, to return gel frome 14 to the removed position, damper 40 acting to smooth the path of said frame 14 to such removed position. However, the usual procedure for moving a gel frame 14 would involve first placing an appropriate switch 58 in the "on" position so that another gel frame 15 moves to also intercept the beam of light from spotlight 10, its such motion being damped by damper 43. Thus, there is a point in time where both gel frames 14, 15 are in register with the beam of light. Frame 14 is then removed and it has been found that such a procedure produces a less discrete change in the lighting than if one frame were removed before the other is placed to intercept the beam of light.

Figure 6:
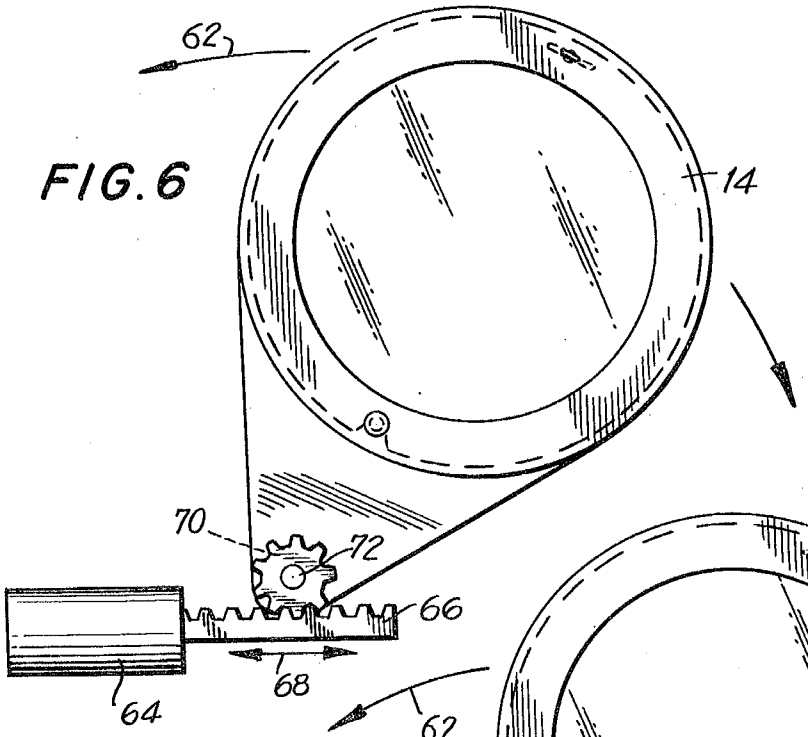
FIG. 6 is a front view of an alternative embodiment of the present invention using a linear solenoid with a rack and pinion gear for moving a gel frame.

Referring to FIG. 6, an alternative embodiment of the present invention is shown to include gel frame 14, movable, as with the preferred embodiment, in the direction depicted by arrows 60, 62. Instead of having a rotary solenoid, linear solenoid 64, by the input of electrical energy (not shown), moves rack and pinion gear 66 in directions depicted by arrow 68, so that pinion 70 rotates axle 72 to move gel frame 14 in directions 60, 62. Unlike the preferred embodiment, no spring biasing means are necessary to return gel frame 14 to its removed position. Rack and pinion gear 66 controls the motion in both directions.

Figure 7:
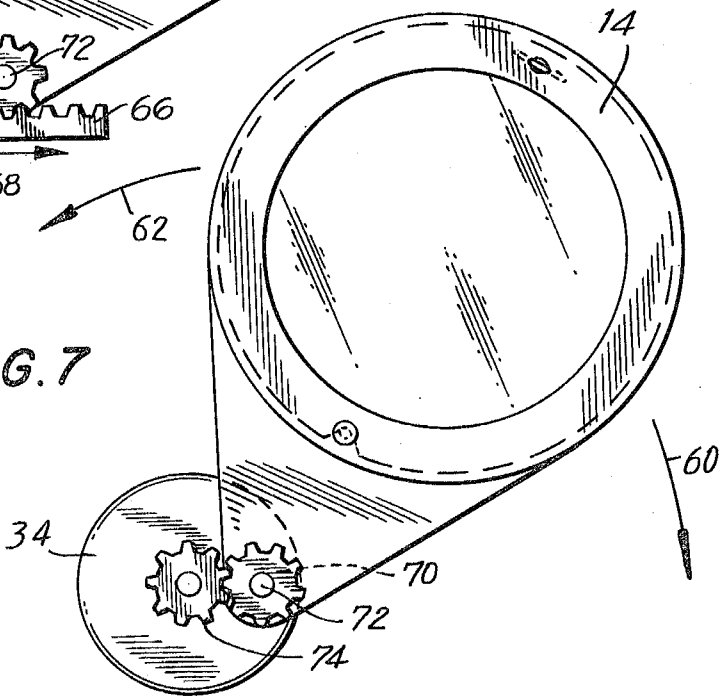
FIG. 7 is a view similar to that of view 6, but showing a further alternative embodiment using a rotary solenoid in connection with pinion gears for causing motion of an individual gel frame.

As a further alternative embodiment, FIG. 7 shows a view similar to that of FIG. 6, but with a pair of pinion gears 70, 74 controlling motion in directions 60, 62 as dictated by the operation of rotary solenoid 34.

In all embodiments, the motion as caused by the solenoid is damped for providing smooth motion of the gel frame as it traverses a path from a removed position to a position intercepting the spotlight beam and then back to a removed position.

The entire structure of the present invention provides an improvement in compactness over the state of the art.

The invention as disclosed herein is to be limited only by the following claims:

What is claimed is:

1. A remote gel changer for a spotlight, emitting a beam of light, comprisng a gel frame for motion between a removed position and a position for intercepting said beam of light, rotary solenoid means for causng said motion of said frame, electrical means for operating said solenoid, remote switch means for causing said electrical operation and a damper connected to said frame for providing smooth motion of said frame as caused by said rotary solenoid.

2. The invention accordng to claim 1 wherein a plurality of gel frames are provided, each attached to an individual solenoid means and a damper.

3. The invention accoding to claim 1 wherein said gel changer also comprises a pair of pinion gears, one affixed to said gel frame and one moved by said solenoid means.

4. The invention according to claim 1 wherein said damper includes a piston and a housing, said piston connected to said frame and said housing affixed with respect to said spotlight.

* * * * *